United States Patent [19]

Kühnert

[11] Patent Number: 4,474,037

[45] Date of Patent: Oct. 2, 1984

[54] KNITTING-TRANSFER CAM UNIT FOR V-BED FLAT KNITTING MACHINES WITH SLIDER NEEDLES

[75] Inventor: Gottfried Kühnert, Aalen, Fed. Rep. of Germany

[73] Assignee: Universal Maschinenfabrik, Westhausen, Fed. Rep. of Germany

[21] Appl. No.: 497,934

[22] Filed: May 25, 1983

[30] Foreign Application Priority Data

May 27, 1982 [DE] Fed. Rep. of Germany ..... 3220055

[51] Int. Cl.[3] ..... D04B 7/00; D04B 15/36; D04B 35/00

[52] U.S. Cl. ..... 66/78; 66/60 R; 66/64; 66/70; 66/76; 66/120

[58] Field of Search ..... 66/78, 76, 70, 64, 60 R, 66/120

[56] References Cited

U.S. PATENT DOCUMENTS

| | | | |
|---|---|---|---|
| 3,605,450 | 3/1969 | Goller et al. . | |
| 3,615,145 | 10/1971 | Goller et al. . | |
| 4,012,927 | 3/1977 | Kühnert . | |
| 4,109,490 | 8/1978 | Bosch | 66/120 |

FOREIGN PATENT DOCUMENTS

| | | | |
|---|---|---|---|
| 2445027 | 4/1976 | Fed. Rep. of Germany . | |
| 2112819 | 7/1983 | United Kingdom | 66/120 |
| 2112820 | 7/1983 | United Kingdom | 66/120 |

*Primary Examiner*—Ronald Feldbaum

*Assistant Examiner*—Mary A. Ellis

*Attorney, Agent, or Firm*—Sughrue, Mion, Zinn, Macpeak & Seas

[57] ABSTRACT

A knitting-transfer cam unit for V-bed flat knitting machines wherein needle butts of the needle bodies of slider needles are selectively lowerable in the needle channels of the needle beds by means of a needle selection device, and wherein the slider needles have sliders provided with slider butts and arranged for the transfer of stitches, comprises stationary and movable cam elements for engagement with the needle butts and the slider butts, and also comprises pressure cam elements. In order to be able to perform any combination of stitch formation and tuck loop formation with each traverse of the carriage, or in order to be able to transfer any stitches without additional transfer cam units, at least one movable cam element for engagement with the needle butts for the formation of stitches is provided and is movable at the positions of carriage reversal, symmetrical movable cam elements are provided for engagement with the needle butts and slider butts for the transfer of stitches, the cam elements for engagement with the slider butts are stationary or movable and are formed such that they define slider butt channels delimited on both sides for a relative movement between needle body and slider in the slider longitudinal direction, a selection position for the needle butts is provided at the central transverse axis of the cam unit and respective selection positions for the needle butts are provided towards each end of the cam unit.

13 Claims, 16 Drawing Figures

S
B
11
A
10
9
6
18
24
23
12
20
25
8
M
22
18
21
15
14
16
6
7

KNITTING-TRANSFER CAM UNIT FOR V-BED FLAT KNITTING MACHINES WITH SLIDER NEEDLES

BACKGROUND TO THE INVENTION

This invention relates to a knitting-transfer cam unit for V-bed flat knitting machines, wherein needle butts of the needle bodies of slider needles are selectively lowerable in the needle channels of the needle beds by means of a needle selection device, wherein the slider needles have sliders provided with slider butts and arranged for the transfer of stitches, wherein stationary and movable cam elements are provided for engagement with the needle butts and the slider butts and are arranged symmetrically with respect to the central transverse axis of the cam unit, and wherein pressure cam elements are provided co-operating with the needle selection device.

One such knitting-transfer cam unit is known for example from DE-OS No. 22 28 547. This known knitting-transfer cam unit comprises movable cam elements both for the needle butts and also for the slider butts, and makes possible, in one carriage traverse, the formation of stitches, the formation of tuck loops, the transfer of stitches from the front needle bed to the rear needle bed or the transfer of stitches from the rear needle bed to the front needle bed.

Other cam units for knitting machines with latch needles are known, with the cam units arranged next to each other, but only capable of knitting or of stitch transfer. Furthermore, such cam units are known which are arranged below one another and operate with double-butt needles. A combined knitting-transfer-double cam unit for latch needles is also known, by means of which one can only transfer stitches in one direction with the particular leading cam unit, for example stitches advancing from right to left forwards and stitches advancing from left to right rearwards.

SUMMARY OF THE INVENTION

It is an object of the present invention to provide a knitting-transfer cam unit of the type first referred to above in which for each carriage traverse one can perform any combination of stitch formation and tuck loop formation, or can transfer any stitches without additional transfer cam units, i.e. independently of the direction of carriage traverse and independently of the direction of transfer, whether this is from the front rearwards, from the rear forwards or simultaneously in both directions.

This is achieved in accordance with the present invention by the following combination of features:

(a) at least one cam element movable in a pivoted manner at the positions of carriage reversal is provided for engagement with the needle butts for the formation of stitches, (b) symmetrical movable cam elements are provided for engagement with the needle butts and slider butts for the transfer of stitches, (c) the cam elements for engagement with the slider butts except those for the transfer of stitches are stationary and are arranged so that they define slider butt channels delimited on both sides for a relative movement between needle body and slider in the longitudinal direction of the slider, and (d) a selection position for the needle butts is provided on the central transverse axis of the cam unit and a selection position for the needle butts is provided towards each end of the cam unit.

With this combined knitting-transfer cam unit one can produce all stitches, tuck loops and no-knit combinations independently of the direction of carriage travel, both forwards and backwards, or one can transfer chosen stitches independently of the direction of carriage traverse and independently of the direction of transfer from the front rearwards, from the rear forwards or simultaneously in both directions. Since the cam unit is a fully symmetrical cam unit, any number of the cam units can be arranged next to one another, for example as double cam units, triple cam units, quadruple cam units, etc.

In one preferred embodiment of the cam unit, all the cam elements provided for engagement with the slider butts are stationary, two movable cam elements moveable forwards into operation at the positions of carriage reversal are arranged symmetrically with respect to the central transverse axis of the cam unit for engagement with the needle butts for the formation of stitches, and the movable cam elements for engagement with the needle butts for the donation of stitches comprise an advancing cam element arranged symmetrically with respect to the central transverse axis of the cam unit and two lowering cam elements arranged symmetrically with respect to the advancing cam element.

The movable cam elements arranged to engage the needle butts for the transfer of stitches are preferably mounted on a common plate and are movable jointly into and out of operation. By this means, with just a single displacement movement at the positions of carriage reversal, one can achieve a switching of the cam unit to the transfer of stitches.

Preferably, the stationary cam elements which are arranged to engage the slider butts define slider butt channels for the formation of tuck loops and acceptance of stitches, for the formation of stitches and for the transfer of stitches. By this means one achieves a trouble-free separation of the different movements of the slider relative to the needle body in the different operational processes.

The stationary cam elements for engaging the slider butts in the transfer of stitches preferably include two protuberances. By means of these two protuberances the stitch which is to be transferred is advancingly drawn on to the stitch support on the slider in a safe manner and, coupled with this, the stitch is somewhat tensioned, so that the accepting needle can pass into the stitch between the two webs of the slider from which the slider is constructed. By the trailing protuberance, the stitch on the slider is brought to the donor position and in a synchronised movement the accepting needle passes through the spread stitch.

In a further preferred embodiment of the cam unit of the present invention all the cam elements for engagement with the slider butts are stationary, a cam element for engaging the needle butts in the formation of stitches is provided so as to be movable in a pivoted manner into operation in a leading sense at the positions of carriage reversal in the plane of the cam unit about the central transverse axis of the cam unit, and the movable cam elements for engaging the needle butts in the transfer of stitches comprise a leading advancing cam element and trailing lowering cam element on each side of the central transverse axis of the cam unit.

Preferably, each one leading advancing cam element and one trailing lowering cam element of the movable cam elements for engaging the needle butts in the donation of stitches are mounted on a common plate and are movable jointly into and out of operation. Also by this means, one achieves a simplification of the changeover of the cam unit for the transfer of stitches at the positions of carriage reversal.

Preferably, the stationary cam elements for engaging the slider butts define slider butt channels for the formation of tuck loops and acceptance of stitches, for the formation of stitches and for the transfer of stitches. In this way one achieves a trouble-free separation of the different movements of the slider relative to the needle body in the different operational processes.

The stationary cam elements between the slider butt channel for the formation of tuck loops and acceptance of stitches and the slider butt channel for the formation of stitches are preferably formed from one central component separated by gaps from two outer parts. In this way one ensures that the slider butts can enter into the corresponding slider butt channels in an ordered manner for the formation of stitches in each direction of travel of the cam unit.

Here also, the stationary cam elements for engaging the slider butts for the transfer of stitches preferably comprise two protuberances having the purpose and function already referred to above.

A third advantageous embodiment of cam unit in accordance with the present invention is constructed in such a way that two movable cam elements are provided symmetrical with respect to the central transverse axis of the cam unit and for engagement with the needle butts for the formation of stitches, said cam elements being movable into operation in a leading sense at the positions of carriage reversal, the movable cam elements for engaging the needle butts in the donation of stitches comprise a lowering cam element symmetrical with respect to the central transverse axis of the cam unit, and the movable cam elements for engaging the slider butts in the donation of stitches comprise two advancing cam elements arranged symmetrically with respect to the withdrawal element.

Preferably, the stationary and movable cam elements for engaging the slider butts define slider butt channels for the formation of tuck loops and acceptance of stitches, for the formation of stitches and for the transfer of stitches.

Preferably, the movable cam elements for engaging the slider butts for the donation of stitches comprise extension elements arranged above a fixed cam element which is symmetrical with respect to the central transverse axis.

BRIEF DESCRIPTION OF THE DRAWINGS

The invention will now be more fully described with reference to preferred embodiments thereof and with reference to the accompanying drawings. In the drawings.

DESCRIPTION OF THE PREFERRED EMBODIMENTS

Figure 1:
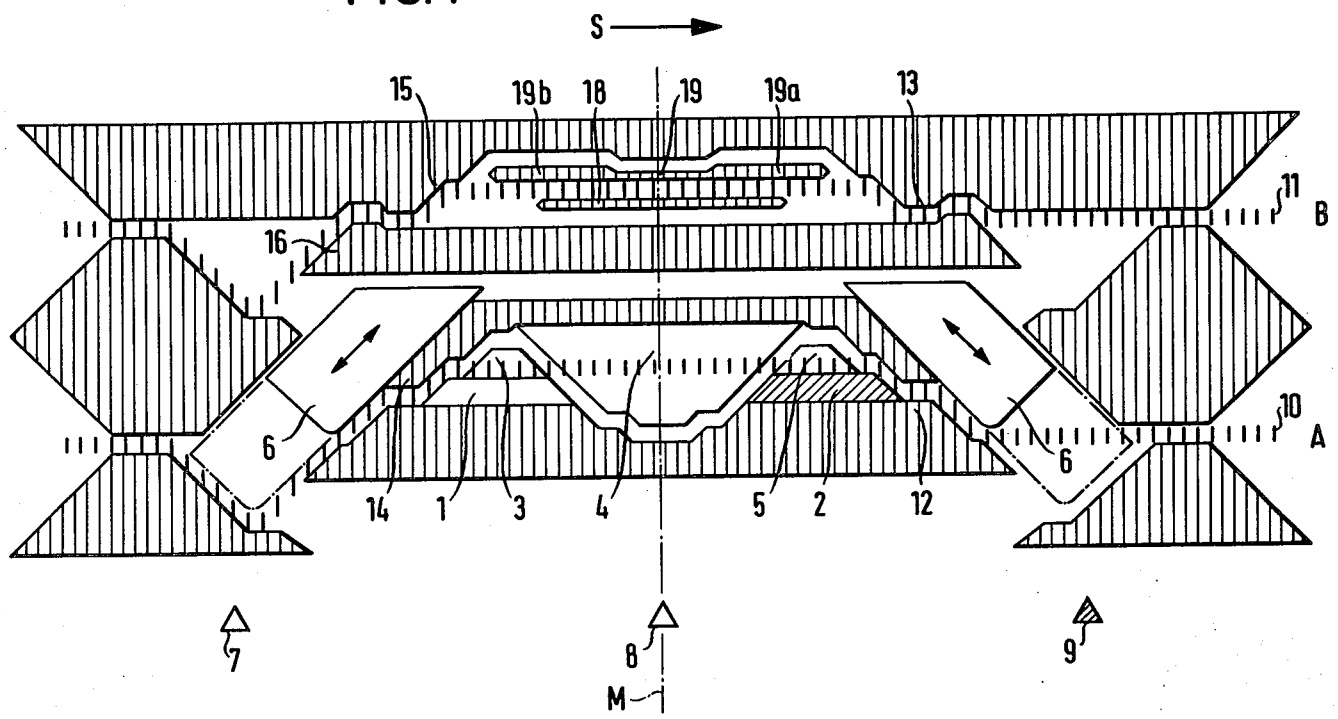
FIG. 1 shows a first preferred embodiment of knitting-transfer cam unit in accordance with the invention for a needle bed of a flat knitting machine, the cam unit being set for the formation of stitches.

The embodiment of a combined knitting-transfer cam unit for slider needles shown in FIGS. 1 to 4 is able to control the needle bodies and to control the sliders of the slider needles in the knitting of stitches and the formation of tuck loops, as well as in the conmbination of both types of knitting in the three-way technique (stitch, tuck, no-knit) and in the donation and acceptance of stitches, as well as both simultaneously, during a course of knitting, i.e. with a traverse of the carriage from left to right or from right to left. The cam unit is constructed so as to be fully symmetrical with respect to the central transverse axis M. Any number of the cam units can therefore be arranged next to one another, for example as a double cam unit, triple cam unit, quadruple cam unit, etc. Each cam unit has a cam zone A for the control of the needle bodies, as well as a cam zone B for the control of the sliders of the slider needles. All stationary cam elements which do not move are indicated by vertical cross-hatching in the drawings. All the displaceable cam elements are either shown without cross-hatching (when displaced out of operation) or with oblique cross-hatching (when displaced into operation).

All the cam elements in cam zone B for the control of the sliders are stationary cam elements.

Figure 2:
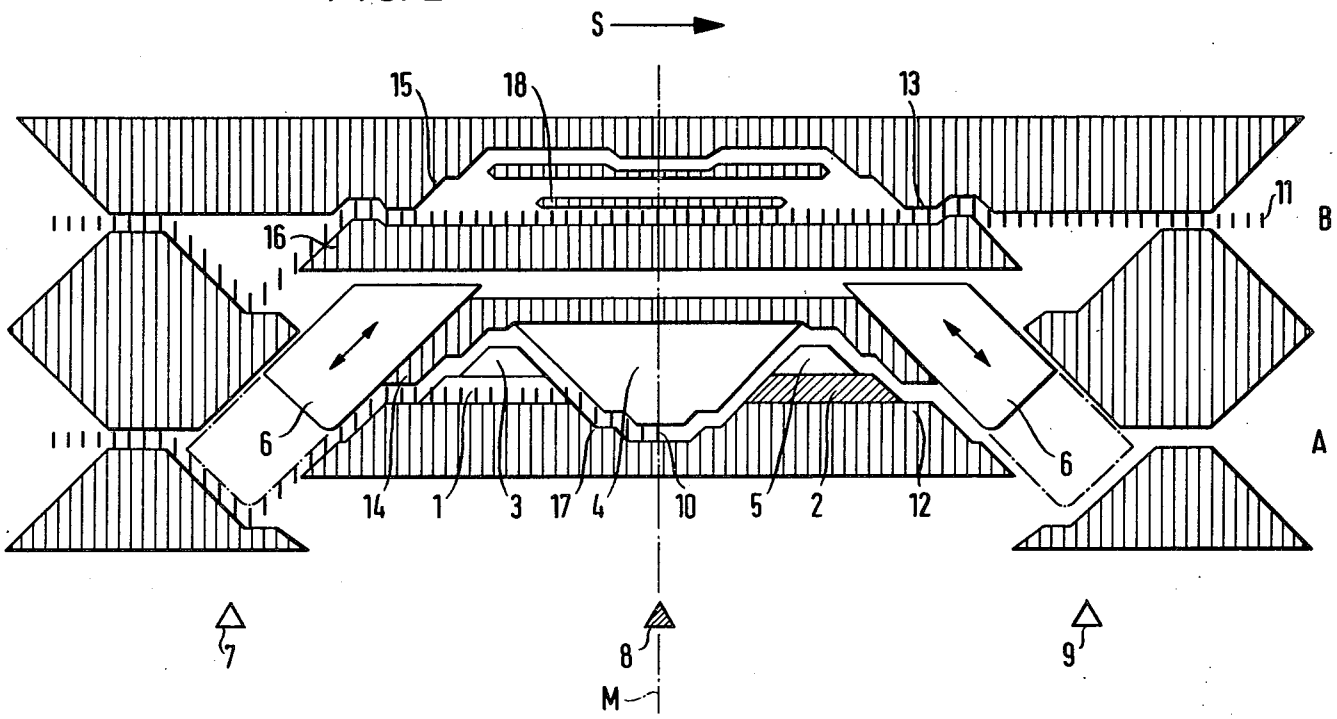
FIG. 2 shows the knitting-transfer cam unit of FIG. 1, set for the formation of tuck loops and the acceptance of stitches.
Figure 3:
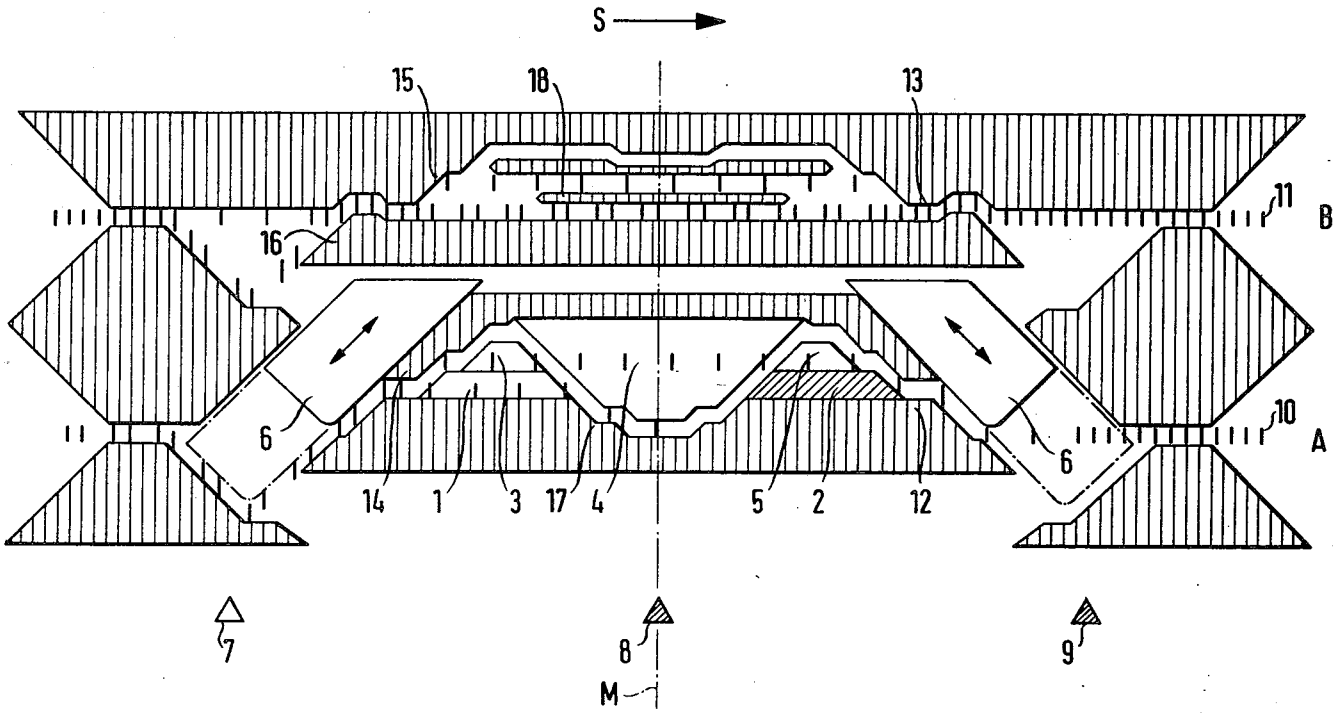
FIG. 3 shows the knitting-transfer cam unit of FIG. 1, set for knitting in the three-way technique (stitch, tuck, no-knit)
Figure 4:
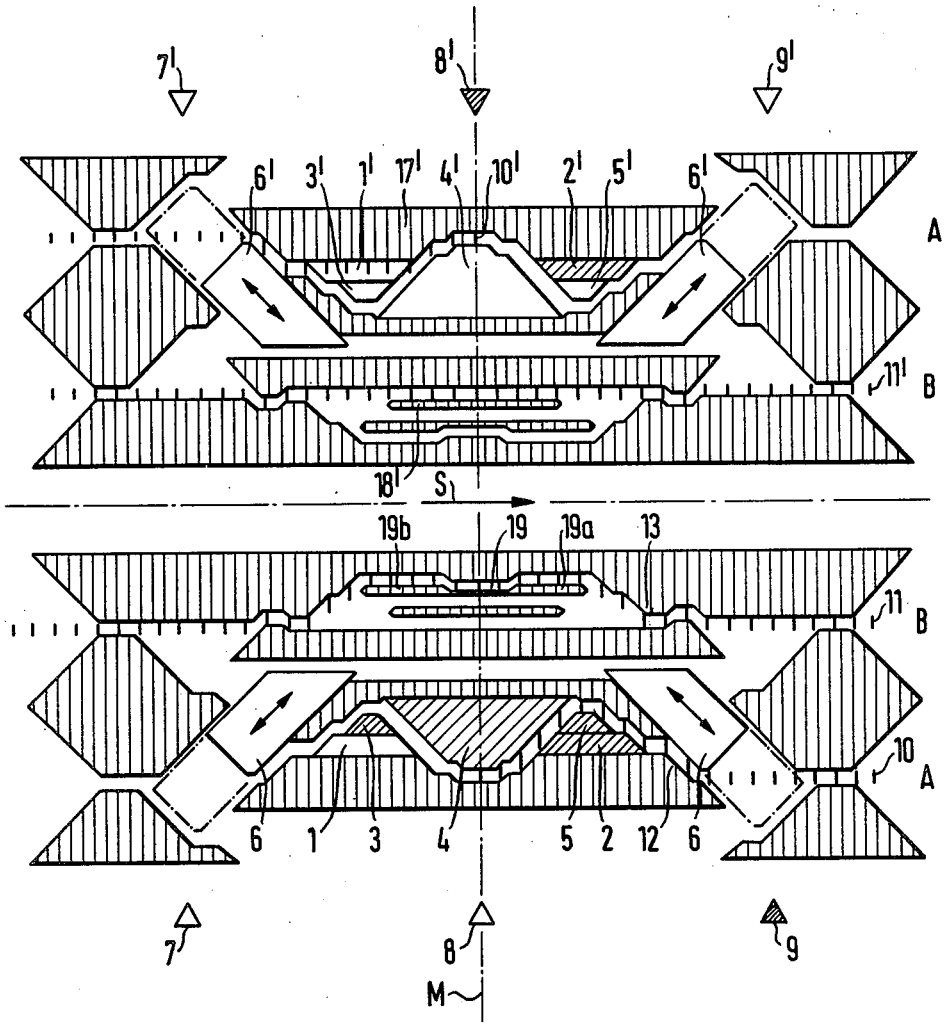
FIG. 4 shows a knitting-transfer cam unit according to FIG. 1, for both needle beds, in which the cam unit for the front needle bed is set for the donation of stitches and the cam unit for the rear needle bed is set for the acceptance of stitches.

In the embodiment of the knitting-transfer cam unit shown in FIGS. 1 to 4, the cam elements 1 and 2 which are arranged to engage the needle butts 10 in the formation of stitches are cam elements which are movable into operation in a leading sense at the positions of carriage reversal, these cam elements being moved automatically with the reversal of the carriage either by lifting into operation or by dropping out of operation. The cam elements 3, 4 and 5 are used for the transfer of stitches. These latter cam elements are mounted on a common plate and are moved jointly into or out of operation. The cam elements 6, with each of which a double-headed arrow is shown, are triangular retractors which are displaceable in the direction of the double-headed arrow in the plane of the cam unit. Each cam unit has a selection position 8 for the needle butts on the central transverse axis M of the cam unit, as well as respective selection positions 7, 9 for the needle butts towards each end of the cam unit. The corresponding cam elements of the cam unit for the rear needle bed are shown in FIG. 4 with primed reference numbers. Of the selection positions 7, 8 and 9 the two leading selection positions are used in the respective directions of traverse of the carriage, i.e. with traverse of the carriage from left to right one uses selection positions 9 and 8, while with a traverse of the carriage from right to left one uses selection positions 7 and 8.

FIG. 1 shows the displaced position of the cam elements for the formation of stitches with a carriage traverse from left to right in the direction of the arrow S. Cam elements 3, 4 and 5 are moved out of operation, while at the left-hand position of carriage reversal cam element 1 has been moved out of operation and cam element 2 has been moved into operation.

Before being engaged by the cam elements the slider needles occupy their basic positions (level cam), with the needle butts 10 and the slider butts 11 in the positions indicated at the right-hand side of FIG. 1. In this position the hooks of the slider needles are closed. At selection position 9, which, as indicated, is in operation, the needle butts 10 are lifted up out of the needle bed into cam zone A. The slider butts 11 do not need to be selected, since they are always in cam zone B.

During upward sliding of the needle butts 10 on cam element 12, the slider butts 11 abut against cam element 13. The needle body and slider undergo a relative movement with respect to each other, until the needle hook has opened and the end of the slider is in contact with the needle body. Both then slide, pushed out by cam element 2, to the stitch trapping level at which the old stitch slides on to the slider. The slider needle lingers in this position until, without relative movement between needle body and slider, it is withdrawn to the thread-laying position by cam elements 14 and 15. Cam element 16 then extends the slider to a certain degree, while the triangular retractor 6 withdraws the needle body. At the end of this relative movement, i.e. when the needle hook has closed again, the needle body and slider slide downwards corresponding to the set withdrawal depth of the triangular retractor 6, and the newly laid thread is formed into the new stitch.

FIG. 2 shows the displaced position of the cam elements for the formation of tuck loops and acceptance of stitches with a traverse of the carriage from left to right in the direction of the arrow S. Cam elements 3, 4 and 5 are out of operation, while cam element 2 has been moved into operation in a leading sense and cam element 1 has been moved a out of operation in a trailing sense. Selection position 8 is in operation. Here, the needle butts 10 of the slider needles which are to form tuck loops are brought into cam zone A and are extended by cam element 17 to the tuck depth. During this upward movement the slider butts 11 are in contact with cam element 18. By means of this there is a relative movement between the needle body and the slider, by which the needle hooks are opened. All further movements follow as for the formation of stitches, but with the difference that the newly laid thread and the old stitch lie jointly on the needle hook and the newly laid thread is formed into the new tuck loop upon withdrawal of the needle to the basic, level cam position.

FIG. 3 shows the displaced position of the cam elements for knitting in the three-way technique with a carriage traverse from left to right in the direction of the arrow S. Here, the needle butts of the slider needles which are to form the stitches are selected at selection position 9, and the needle butts of the slider needles which are to form tuck loops are selected at selection position 8. Those slider needles which are not to knit remain in their basic position in which the needle butts 10 remain lowered in the needle bed and cannot be engaged by the cam unit.

FIG. 4 shows the displaced position of the cam elements of the cam units for both the front and rear needle beds for the donation of stitches from the front bed rearwards with a traverse of the carriage from left to right in the direction of the arrow S.

Cam elements 2,2' are moved into operation and cam elements 1,1' are moved out of operation. Cam elements 3,4 and 5 are moved into operation.

The needle butts 10 of the slider needles which are to donate stitches are brought into operation at selection position 9, and the needle butts 10' of the slider needles which are to accept stitches are brought into operation at selection position 8'. They are then in the respective cam zones A. The slider butts 11 and 11' require no selection since they always remain in the respective cam zones B.

When now the carriage is moved to the right, the needle butts 10 of the front slider needles are extended by cam elements 12, 2 and 5 until the slider butts 11 are struck by cam element 19 and are held by this, after which the needle hooks are opened in the region of cam element 13 by a relative movement between needle body and slider. The sliders have reached the level at which their stitch supports already hold the stitches spread open for the insertion of the counterpart needles.

Cam element 4 brings the needle body back, by means of its needle butt 10, to the basic, level cam position, and shortly before selection position 8 moves out of operation, i.e. the needle butt 10 disappears into the needle bed, whereby the needle body has its trailing stem resting on a pivot jack. The slider butts 11 remain in their occupied positions until the needle butts 10' of the rear, accepting needles are selected at selection position 8' and are extended by cam element 17'. Cam element 18' holds the slider butts 11' during the needle movement until the needle hooks have opened and the slider needle having the needle butt 10' has entered into the spread front stitch. The trailing withdrawal movements of the donating sliders with their slider butts 11, as well as the accepting needle bodies with their needle butts 10' ensure a trouble-free donation and acceptance of the stitches from the front slider needles to the rear slider needles.

Cam element 19 is provided with two protuberances 19*a* and 19*b* which have the purpose, during the advancing of the stitches to be transferred, of holding them securely on the stitch supports on the sliders and subsequently slightly tensioning the stitches, so that the accepting slider needles in front of the stitches can thread in between the two webs of the slider. Thereafter, the stitch is brought to the donating position by the trailing protuberance 19*b* and by a synchronised movement the accepting slider needle passes through the spread stitch.

FIGS. 5 to 8 show a further embodiment of combined knitting-transfer cam unit for slider needles. The parts of the cam unit which correspond to those of FIGS. 1 to 4 are indicated by the same reference numbers. Instead of the cam elements 3, 4 and 5 of the cam unit in FIGS. 1 to 4, the cam unit shown in FIGS. 5 to 8 has movable cam elements 21 and 22 as well as 23 and 24. The advancing cam element 21 and the withdrawal cam element 22, as well as the advancing cam element 24 and the covering cam element 23, are respectively mounted jointly on a plate and are separately movable accordingly. Instead of the cam elements 1 and 2 of the cam unit of FIGS. 1 to 4, in the cam unit of FIGS. 5 to 8 there is provided a cam element 25 for engaging the needle butts 10 in the formation of stitches, this cam element 25 being automatically swung into operation in a pivoted manner in a leading sense at the positions of carriage reversal in the plane of the cam unit about the central transverse axis M of the cam unit. FIGS. 5 to 8 show the titlted position of the cam element 25 for the direction of traverse of the carriage from left to right in the direction of the arrow S.

Figure 5:
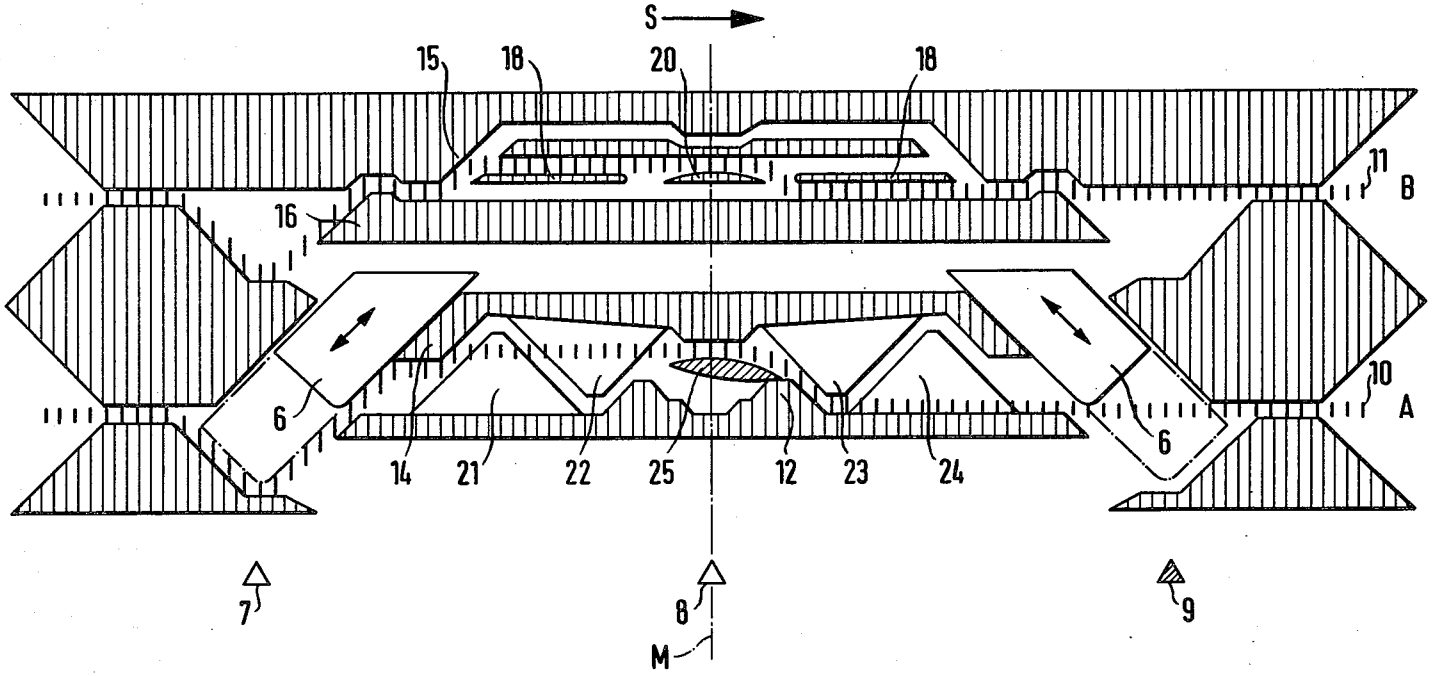
FIG. 5 shows a second embodiment of knitting-transfer cam unit in accordance with the invention for a needle bed of a flat knitting machine, the cam unit being set for the formation of stitches.

FIG. 5 shows the displaced position of the cam elements for the formation of stitches. Cam elements 21, 22 and 23, 24 are moved out of operation, and the automatically swinging cam element 25 is in the correct position for the carriage traverse from left to right. The needle butts 10 whose slider needles are to form stitches are selected at selection position 9, i.e. the needle butts 10 are lifted up from the needle bed and brought into cam zone A. Cam element 12 moves the slider needles with the needle butts 10 upwards. During this upward movement cam element 18 holds the slider by the slider butt 11 in its position so that during this time the closed needle hook is opened and the end of the slider comes into contact with the needle body.

After the opening of the needle hook cam element 25 takes over the further extension movement. The stationary composite cam element between the slider butt channel for the formation of tuck loops and acceptance of stitches and the slider butt channel for the formation of stitches is here formed from one central element 20 having a gap between it and each of two outer element 18, 18. During the further extension of the needle bodies by cam element 25, the slider butts 11 slide over element 20. This is the position in which the old stitch comes to lie on the slider. The withdrawal movement of the needle body (needle butt 10) and of the slider (slider butt 11) which follows thereafter by cam elements 14 and 15 brings the slider needle into the thread-laying position. Cam element 16 moves the slider in the direction of the needle hook, while cam element 6 retracts the needle body downwards. The relative movement which thereby arises between needle body and slider ends when the needle hook is closed, the newly laid thread lies in the needle hook and the old stitch is on the slider. Upon the further joint withdrawal movement of needle body and slider the old stitch is then thrown off over the closed needle hook and the newly laid thread is formed into the stitch.

Figure 6:
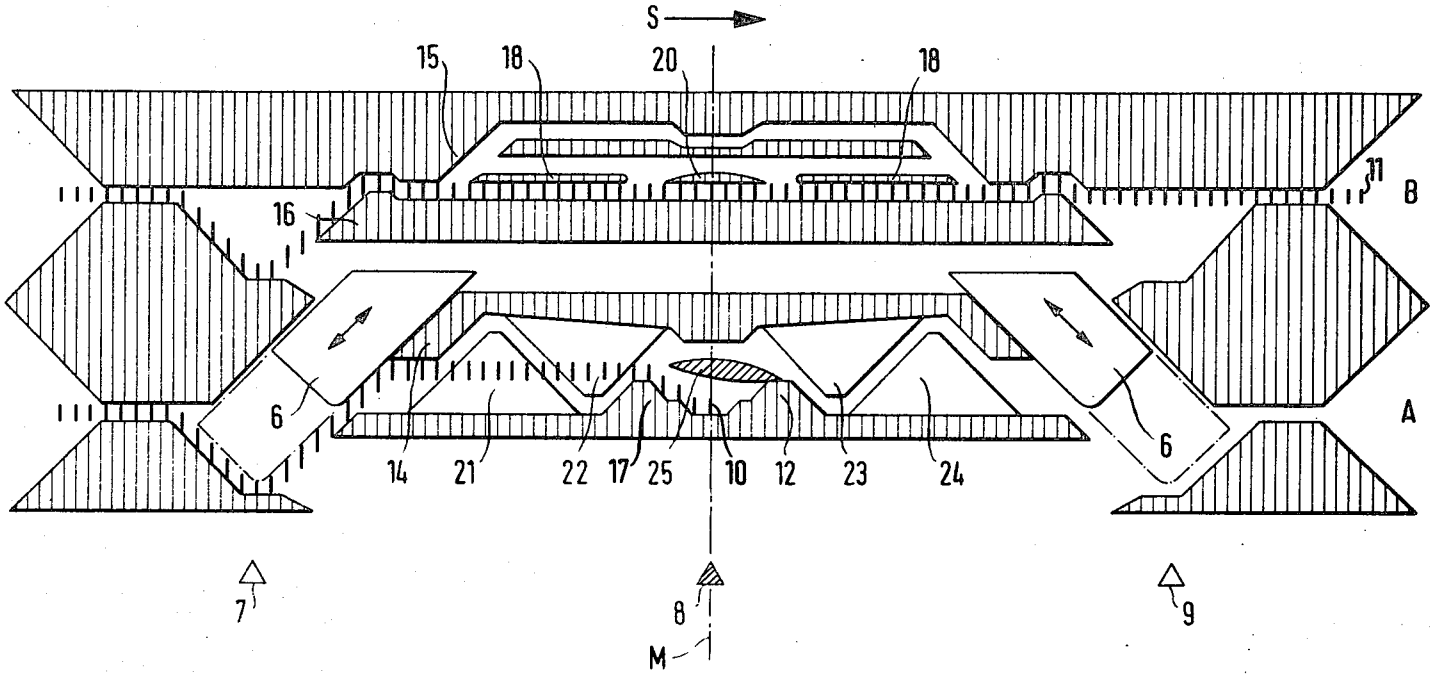
FIG. 6 shows the knitting-transfer cam unit of FIG. 5 set for the formation of tuck loops and the acceptance of stitches.

FIG. 6 shows the displaced position of the cam elements for the formation of tuck loops and acceptance of stitches for a carriage traverse in the direction of the arrow S from left to right. Cam elements 21, 22, 23 and 24 are out of operation. The needle butts 10 of the slider needles which are to form tuck loops are selected at selection position 8, and, with traverse of the carriage to the right, are extended to the tuck depth by cam element 17. During this time the slider butts 11 are held by cam element 20 so that the needle hooks are open and are ready for the laying of the thread. Upon trailing withdrawal, the old stitch and the newly laid thread lie jointly in the needle hook, with the result that the newly laid thread is formed into the tuck loop upon further withdrawal to the basic, level cam position.

Figure 7:
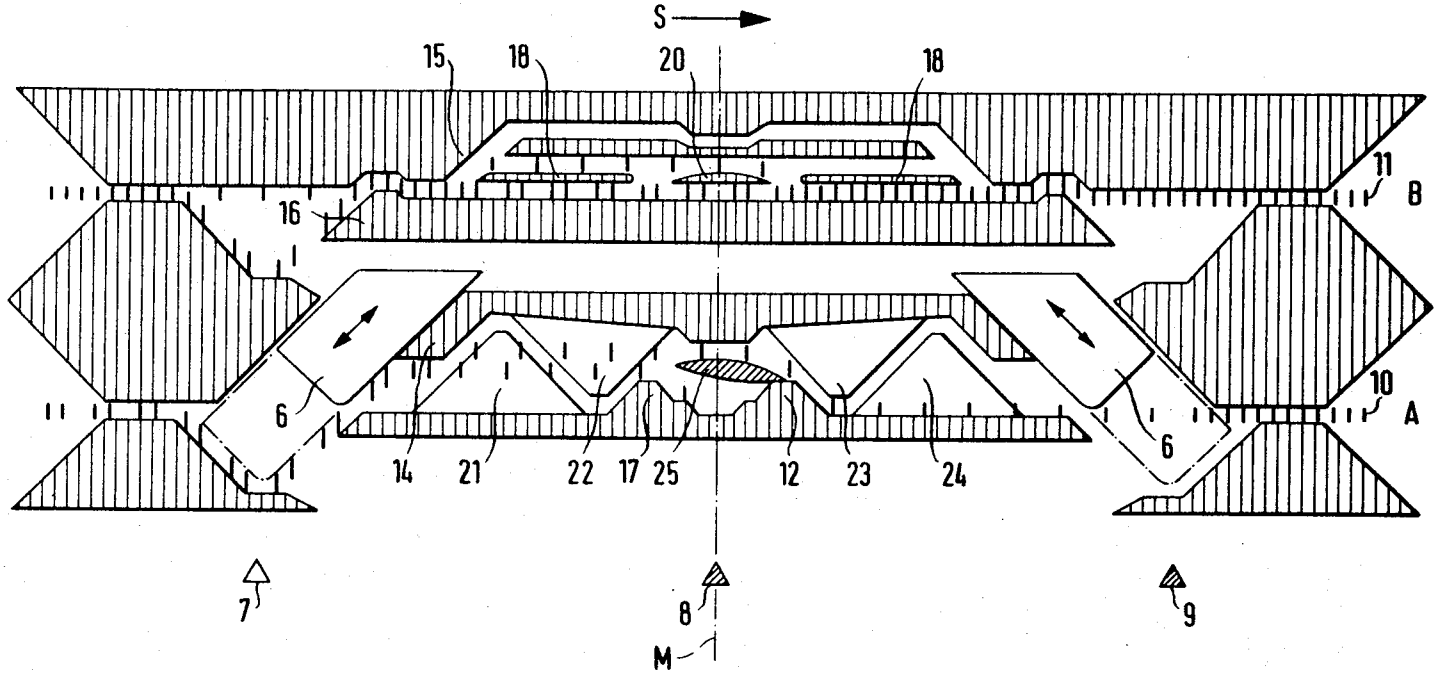
FIG. 7 shows the knitting-transfer cam unit of FIG. 5 set for knitting in the three-way technique (stitch, tuck, no-knit)

FIG. 7 shows the displaced position of the cam elements for knitting in the three-way technique with a carriage traverse from left to right in the direction of the arrow S. Cam elements 21, 22, 23 and 24 are out of operation. Here, the needle butts 10 of the slider needles which are to form stitches are selected at selection position 9 and the needle butts 10 of the slider needles which are to form tuck loops are selected at selection position 8. Those slider needles which are not to knit remain in their basic positions in which the needle butts 10 remain lowered in the needle bed and cannot be engaged by the cam unit.

Figure 8:
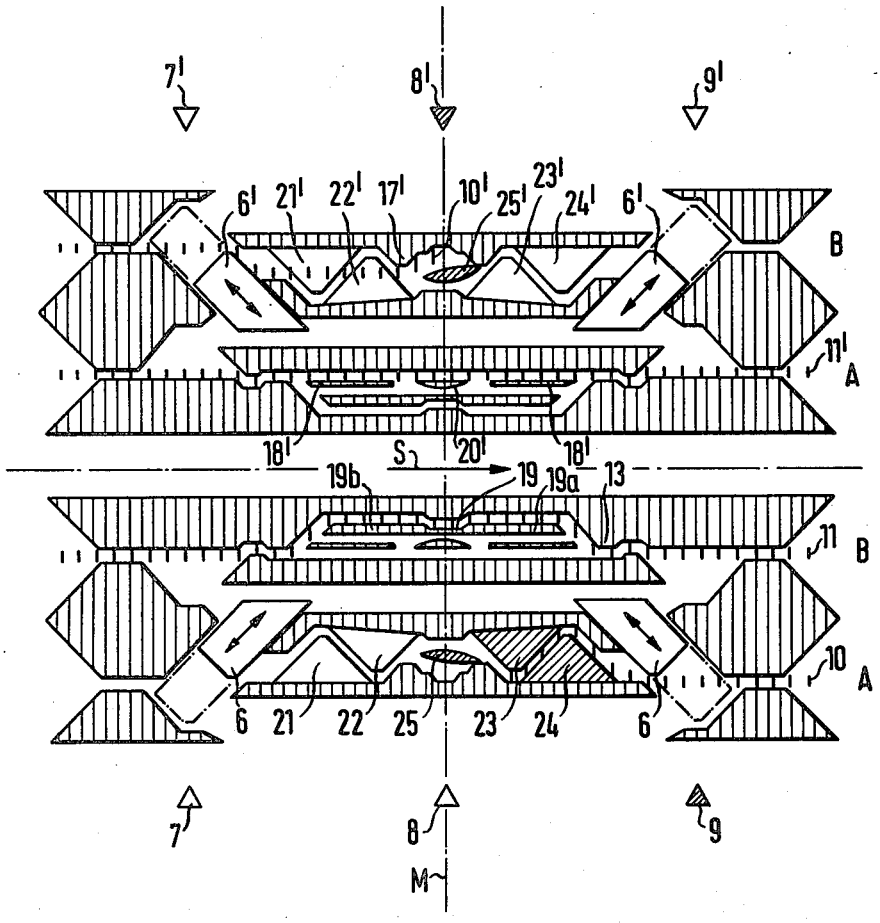
FIG. 8 shows a knitting-transfer cam unit according to FIG. 5, for both needle beds, in which the cam unit for the front needle bed is set for the transfer of stitches and the cam unit for the rear needle bed is set for the acceptance of stitches.

FIG. 8 shows the displaced position of the cam elements of the cam units for both the front needle bed and the rear needle bed for the donation of stitches from the front bed rearwards with traverse of the carriage from left to right in the direction of the arrow S. Cam elements 23 and 24 are moved into operation.

The needle butts 10 of the slider needles which are to donate stitches are brought into operation at selection position 9. Upon the extension of the slider needles with their needle butts 10 by cam element 24, the slider butts 11 are held by cam element 13 until the needle hooks are open and the sliders have been automatically entrained after this by the needle bodies. At the highest extended position the slider has its butt 11 in the region of cam element 19. In this position the stitches are spread open and are brought to the position in which the slider needles from the rear needle bed can enter the stitches. Before this can take place however the needle bodies in the front needle bed must be returned to the basic, level cam position. Cam element 23 retracts the slider needle with the needle butt 10, while the slider with its slider butt 11, held by cam element 19, retains the position it occupies.

Cam elements 21 and 22 are moved out of operation.

When the slider needle with the needle butt 10 in the front needle bed has achieved its level cam position, then, in the rear cam unit, the slider needles with the needle butts 10' are moved into operation at selection position 8' in order to accept the stitches. Cam elements 21', 22' and 23', 24' are out of operation. The chosen slider needles with the needle butts 10' are brought by cam element 17' into the tuck or acceptance position. Upon extension the slider butts 11' are held by cam element 20' so that the needle hooks are opened and can enter into the already held stitches. The transfer of stitches in one direction of traverse of the carriage can be effected at the same time from the front needle bed to the rear needle bed and from the rear needle bed to the front needle bed.

Here again, cam element 19 is provided with two protuberances 19*a* and 19*b* which have the same purpose as already described above in relation to FIGS. 1 to 4.

Figure 9:
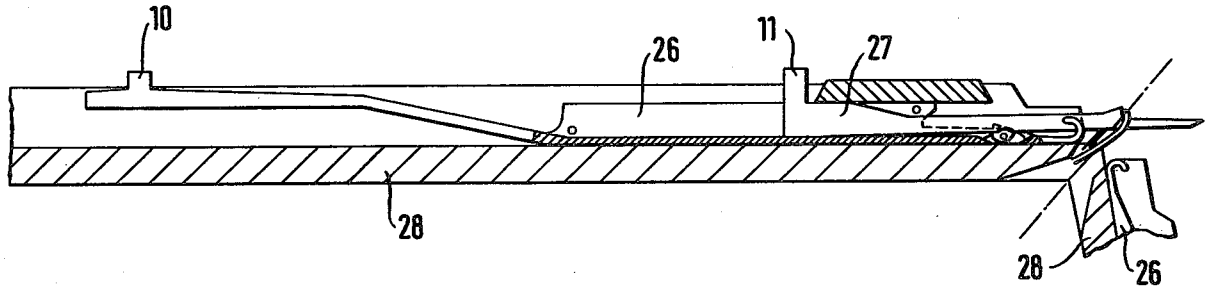
FIG. 9 shows a slider needle in its position for the donation of a stitch.

FIG. 9 shows a stitch-donating slider needle with needle body 26 and slider 27 in a needle bed 28 in the position in which the stitch to be donated lies on and is spread apart by the stitch supports of the slider 27. The needle body comprises a needle butt 10 and the slider comprises a slider butt 11. A stitch-accepting slider needle stands ready in the opposing needle bed to receive the stitch.

FIGS. 10 to 13 show a further embodiment of a combined knitting-transfer cam unit for slider needles by means of which an even more reliable motion can be achieved in the transfer of stitches. The cam unit construction corresponds generally to that already described in connection with the embodiment shown in FIGS. 1 to 4; movable cam elements 3 and 5, which are used for the donation of the stitches, instead of being arranged in cam zone A for the control of the needle bodies, are here arranged instead in cam zone B for the control of the sliders of the slider needles, and are indicated at 30 and 31. All other cam elements in cam zone B for the control of the sliders are stationary cam elements. The movable cam elements 30 and 31 are arranged symmetrically with respect to the central transverse axis M of the cam unit and are positioned above the fixed cam element 19 which at the same time takes over the function of cam element 18.

Figure 10:
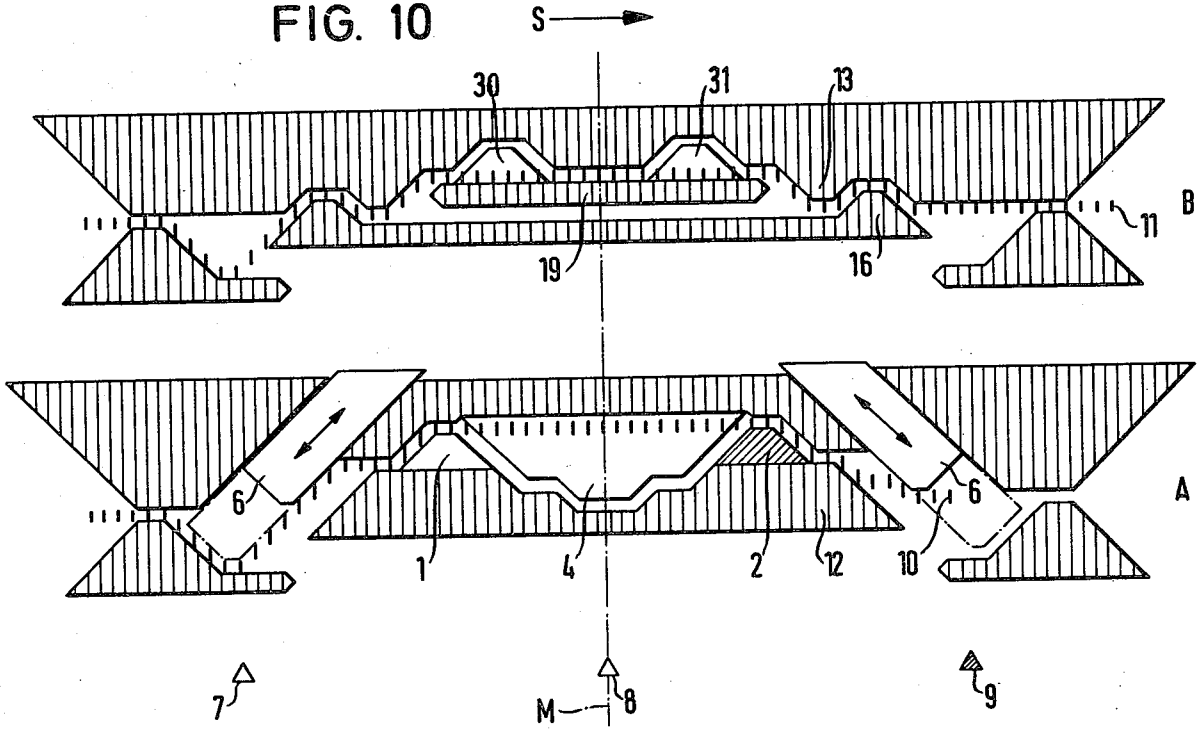
FIG. 10 shows a third embodiment of knitting-transfer cam unit in accordance with the invention for a needle bed of a flat knitting machine, the cam unit being set for the formation of stitches.

FIG. 10 shows the displaced position of the cam elements for the formation of stitches with a carriage traverse from left to right in the direction of the arrow S. Cam elements 1 and 2 are again movable automatically into operation in a leading sense and out of operation in a trailing sense. Upon carriage traverse from left to right, cam element 2 is moved into operation. Cam element 4 in cam zone A, as well as cam elements 30 and 31 in cam zone B, are moved out of operation.

Selection position 9 is in operation as indicated. At this position those needles are chosen which are to knit stitches. For this purpose the needle butts 10 arise from the needle bed so that they can be engaged by cam element 12. The slider butts 11 are engaged by cam element 16 and undergo an upward and downward movement. During this time the needle butts 10 move upwards.

In the region of cam element 13 relative movement between the needle butts and slider butts ends, i.e. the needle hooks are open. The slider then lies on the needle body and is moved upwards by it upon further extension movement by cam element 2, until the slider butt 11 has reached the position above cam element 19. In this position the needle itself has reached its maximum extension, so that during the trailing withdrawal the thread can be laid. The further process is the same as for the cam unit described above in connection with FIG. 1.

Figure 11:
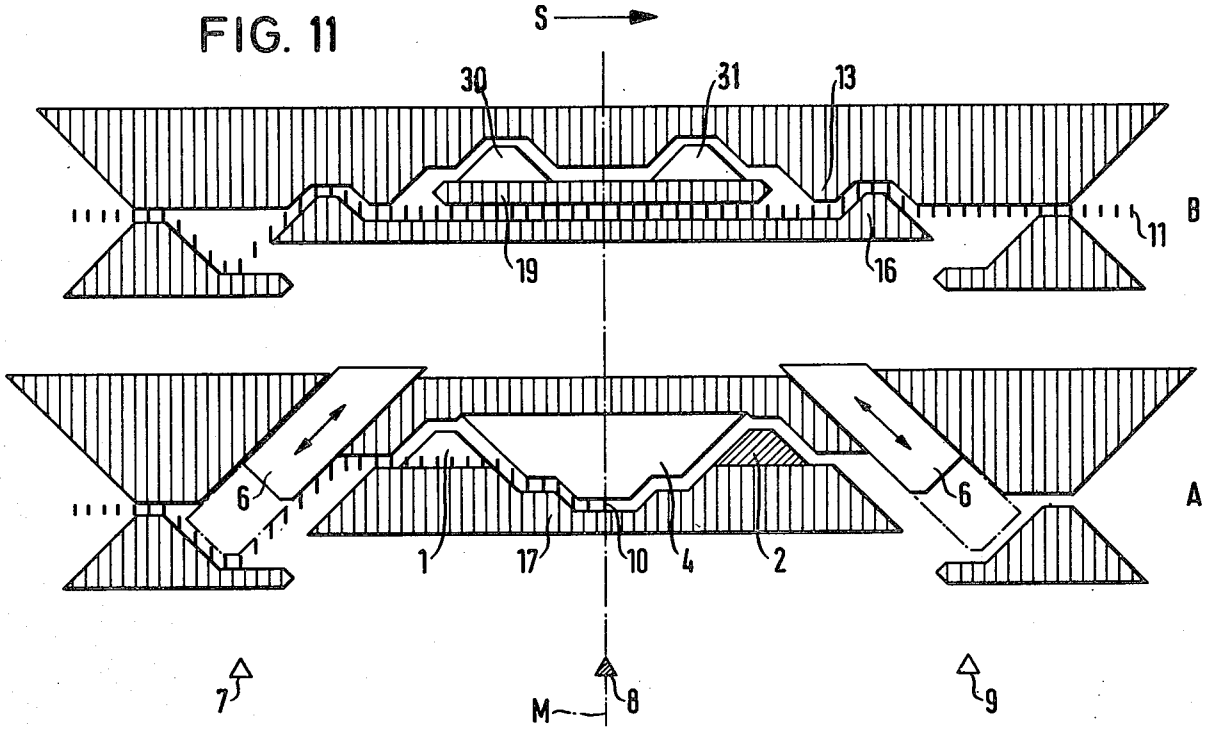
FIG. 11 shows the knitting-transfer cam unit of FIG. 10, set for the formation of tuck loops and for the acceptance of stitches.

FIG. 11 shows the displacement of the cam elements for the formation of tuck loops and acceptance of stitches with a carriage traverse from left to right in the direction of the arrow S. The displacement of the cam elements is substantially the same as described above in connection with FIG. 10, although here selection position 8 is in operation and selects the needles which are to knit tuck loops. The needle butts 10 are present in cam zone A and are extended by the driving edge of cam element 17. During this time the slider butts 11 are held by cam element 19, and in consequence the needle hooks are open. Since cam element 1 has been moved out of operation in a trailing pendular sense, the needles remain at the tuck height and are withdrawn in trailing operation for the laying of thread and formation of tuck loops, as described above in connection with FIG. 2.

Figure 12:
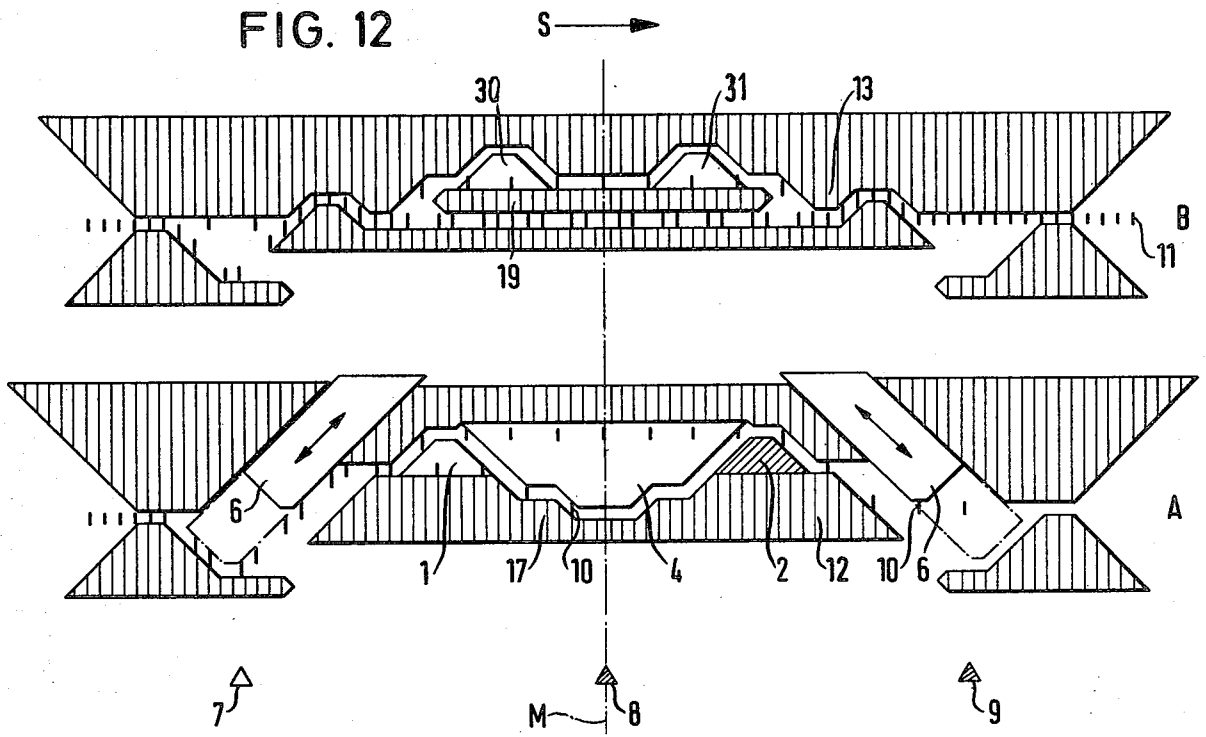
FIG. 12 shows the knitting-transfer cam unit of FIG. 10, set for the three-way technique (stitch, tuck, no-knit)

FIG. 12 shows the displaced position of the cam elements for knitting in the three path technique with a carriage traverse from left to right in the direction of the arrow S. Here, cam element 2, again leading, has been displaced in pendular manner into operation and cam element 1, again trailing, has been displaced in pendular manner out of operation, with cam elements 4, 30 and 31 out of operation. With traverse of the carriage to the right, the needle butts 10 of the slider needles which are to form stitches are selected at selection position 9, and the needle butts 10 of the slider needles which are to form tuck loops are selected at selection position 8. All needles which are not selected are out of operation. The needle motion is the same as already described above.

Figure 13:
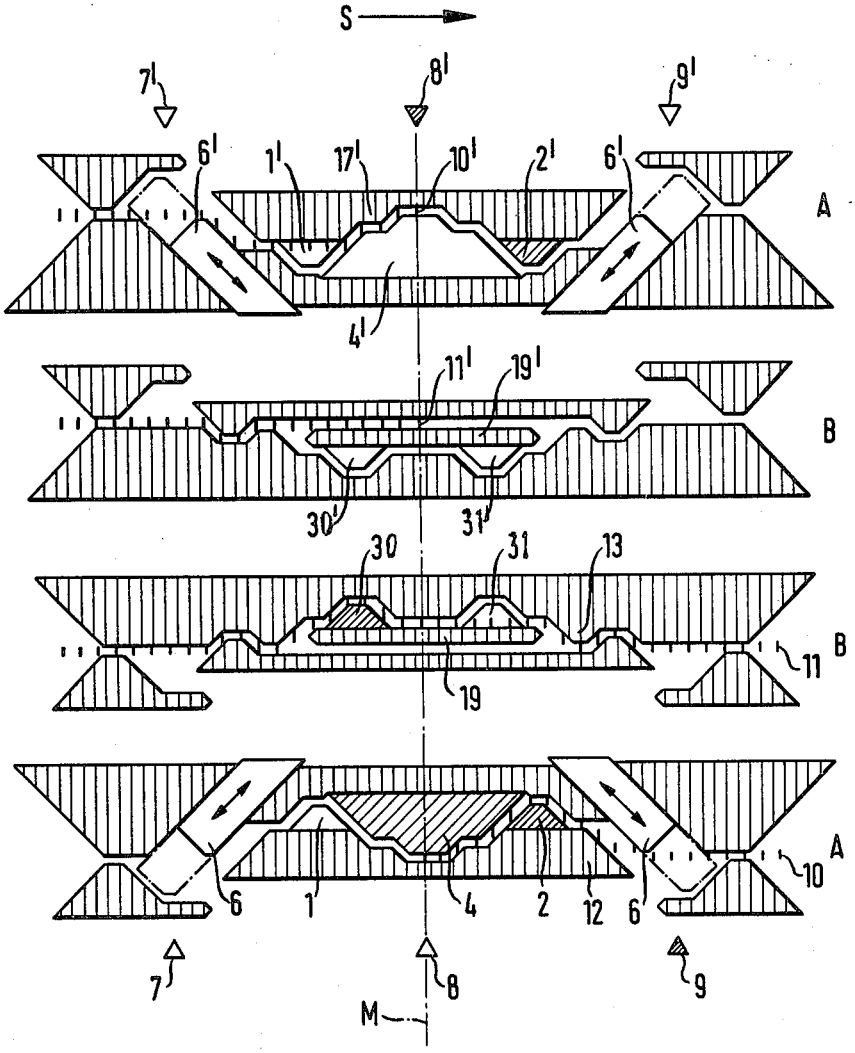
FIG. 13 shows a knitting-transfer cam unit according to FIG. 10, for both needle beds, in which the cam unit for the front needle bed is set for the donation of stitches and the cam unit for the rear needle bed is set for the acceptance of stitches; and, FIGS. 14 to 16 show different positions in the transfer of a stitch from a donor slider to an accepting needle with a cam unit as shown in FIG. 10.

FIG. 13 shows the displaced position of the cam elements of the cam units for both the front and rear needle beds for the donation of stitches from the front bed rearwards with traverse of the carriage from left to right in the direction of the arrow S. With corresponding movement of the cam elements the cam unit can transfer either from the rear bed forwards or in both directions simultaneously and also in both directions of traverse of the carriage. Cam elements 2, 2' are moved into operation in pendular manner in a leading sense and cam elements 1, 1' are moved out of operation in pendular manner in a trailing sense. Cam elements 30 and 4 are moved into operation and cam element 31 is moved out of operation.

The needle butts 10 of the slider needles which are to donate stitches are chosen at selection position 9 and are pushed out by cam elements 12 and 2. The slider butts 11 are held by cam element 13 until the needle hooks are open and the sliders are automatically entrained by the needle bodies. At the position of maximum extension the slider butts 11 are taken over by cam element 19, while the needle bodies are retracted again to the basic, level cam position by cam element 4 which engages against the needle butts 10. The front slider needles linger in this position until the rear, accepting slider needles have been chosen at selection position 8' and have been extended by cam element 17'.

Figure 14:
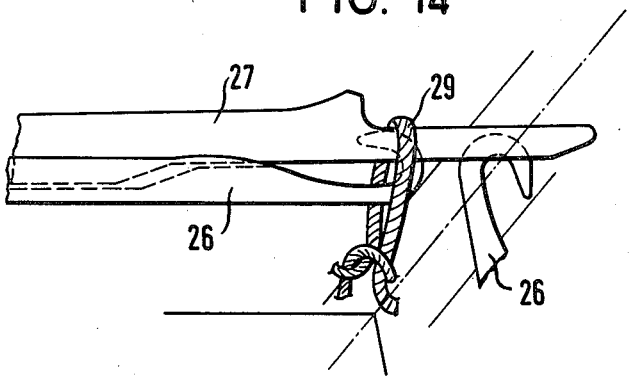
Figure 15:
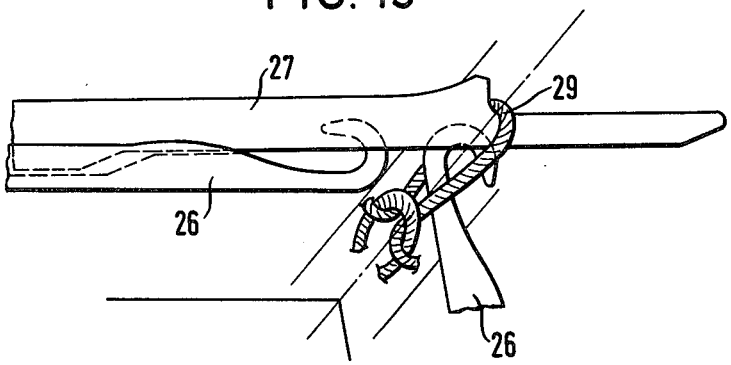
Figure 16:
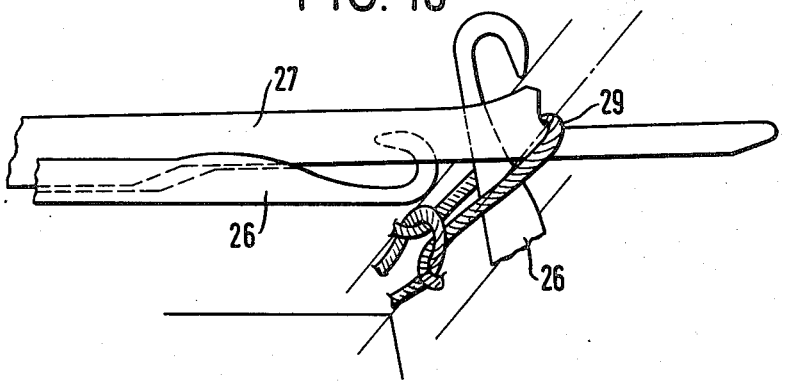

When the rear slider needles have reached the first step of cam element 17', the needle hook is opened and is threaded between the readied slider webs of the corresponding front slider, as is shown in FIG. 14. Then, the front slider is extended by cam element 3 engaging its slider butt 11. Thus, the stitch is lifted from the stitch support over the hook of the rear, accepting needle, as is shown in FIG. 15. When this position has been achieved, the rear, accepting slider needle is lifted by cam element 17' into receiving position (tuck height). Thus, the needle hook of the accepting needle passes through the stitch, as is shown in FIG. 16. With subsequent withdrawal of the donating slider the stitch drops on to the needle hook of the accepting needle, so that this can then be taken back to the basic, level cam position.

In FIGS. 14, 15 and 16 the needle body is indicated at 26, the slider at 27 and the stitch to be transferred at 29. It will be seen from this that during the donation of the stitch 29 the slider webs of the donating slider 27 are held spread apart without difficulty by the needle hook and the needle body 26 of the accepting slider needle.

I claim:

1. A knitting-transfer cam unit for V-bed flat knitting machines, wherein needle butts of the needle bodies of slider needles are selectively pressable into the needle channels of the needle beds by means of a needle selection device, wherein the slider needles has sliders provided with slider butts and are arranged for the transfer of stitches, wherein stationary and moveable cam elements are arranged symmetrically relative to the central transverse axis of the cam unit for engagement with the needle butts and the slider butts, and wherein pressure cam elements are provided cooperating with the needle selection device, in which (a) at least one cam element forcibly shiftable into operation in a leading sense at the positions of carriage reversal is provided for engagement with the needle butts for the formation and the transfer of stitches, (b) symmetrical selectively shiftable cam elements are provided for engagement with the needle butts and slider butts respectively, for the transfer of stitches, (c) the cam elements being arranged to engage the slider butts formed such that they define slider butt channels delimited on both sides for a relative movement between needle body and slider in the longitudinal direction of the slider, and (d) a selection position for the needle butts is provided on the central transverse axis of the cam unit and a selection position for the needle butts is provided towards each end of the cam unit.

2. A knitting-transfer cam unit according to claim 1 in which all the cam elements provided for engagement with the slider butts are stationary, two cam elements forcibly shiftable into operation in a leading sense at the positions of carriage reversal are arranged symmetrically with respect to the central transverse axis of the cam unit for engagement with the needle butts for the formation and the transfer of stitches, and the selectively shiftable cam elements arranged to engage the needle butts for the transfer of stitches comprise a lowering cam element arranged symmetrically with respect to the central transverse axis of the cam unit and two advancing cam elements arranged symmetrically with respect to the lowering cam element.

3. A knitting-transfer cam unit according to claim 2 in which the selectively shiftable cam elements arranged to engage the needle butts for the transfer of stitches are mounted on a common plate and are shiftable jointly into and out of operation.

4. A knitting-transfer cam unit according to claim 2 in which the stationary cam elements which are arranged to engage the slider butts define slider butt channels for the formation of tuck loops, for the acceptance of stitches, for the formation of stitches, and for the donation of stitches.

5. A knitting-transfer cam unit according to claim 2 in which the stationary cam elements arranged to engage the slider butts for the transfer of stitches comprise two protuberances.

6. A knitting-transfer cam unit according to claim 1 in which all the cam elements for engagement with the slider butts are stationary, a pivotable cam element for engaging the needle butts in the formation of stitches is provided so as to be forcibly shiftable into operation in a leading sense at the positions of carriage reversal in the plane of the cam unit about the central transverse axis of the cam unit, and the selectively shiftable cam elements for engagement with the needle butts in the transfer of stitches comprise a leading advancing cam element and trailing lowering cam element on each side of the central transverse axis of the cam unit.

7. A knitting-transfer cam unit according to claim 6 in which each one leading advancing cam element and one trailing lowering cam element of the selectively shiftable elements for engagement with the needle butts in the transfer of stitches are mounted on a common plate and are shiftable jointly into and out of operation.

8. A knitting-transfer cam unit according to claim 6 in which the stationary cam elements arranged to engage the slider butts define slider butt channels for the formation of tuck loops, for the acceptance of stitches, for the formation of stitches, and for the transfer of stitches.

9. A knitting-transfer cam unit according to claim 8 in which the stationary cam elements between the slider butt channel for the formation of tuck loops and for the acceptance of stitches and the slider butt channel for the formation of stitches are formed from a central element separated by gaps from two outer parts.

10. A knitting-transfer cam unit according to claim 6 in which the stationary cam elements arranged to engage the slider butts in the transfer of stitches comprise two protuberances.

11. A knitting-transfer cam unit according to claim 1, comprising two cam elements for engagement with the needle butts in the formation and the transfer of stitches arranged symmetrically with respect to the central transverse axis of the cam unit and each forcibly shiftable into operation in a leading sense at the positions of carriage reversal wherein the selectively shiftable cam elements arranged to engage the needle butts in the transfer of stitches comprise a lowering cam element symmertical with respect to the central transverse axis of the cam unit, and wherein the selectively shiftable cam elements arranged to engage the slider butts in the transfer of stitches comprise two advancing cam elements arranged symmetrically with respect to the lowering cam element.

12. A knitting-transfer cam unit according to claim 11 in which the stationary and shiftable cam elements for engagement with the slider butts define slider butt channels for the formation of tuck loops, for the acceptance of stitches, for the formation of stitches and for the transfer of stitches.

13. A knitting-transfer cam unit according to claim 11 in which the shiftable cam elements for engagement with the slider butts in the transfer of stitches comprise advancing cam elements arranged above a fixed cam element which is symmetrical with respect to the central transverse axis.

* * * * *

UNITED STATES PATENT AND TRADEMARK OFFICE

CERTIFICATE OF CORRECTION

PATENT NO. : 4,474,037

DATED : October 2, 1984

INVENTOR(S) : Gottfried KUHNERT

It is certified that error appears in the above-identified patent and that said Letters Patent is hereby corrected as shown below:

On the title page, assignee should read:

-- (73) Assignee: Universal Mashinenfabrik Dr. Rudolf Schieber GmbH & Co. KG, Westhausen, Fed. Rep. of Germany --.

Signed and Sealed this

Seventh Day of May 1985

[SEAL]

*Attest:*

DONALD J. QUIGG

*Attesting Officer*

*Acting Commissioner of Patents and Trademarks*